US005941392A

United States Patent [19]

Huang et al.

[11] Patent Number: 5,941,392

[45] **Date of Patent: *Aug. 24, 1999**

[54] READILY MOVABLE RECLINED BAG RACK AND BAGGING RACK SYSTEM THEREOF

[75] Inventors: Frank Feng Jung Huang; Daniel Huang, both of Tustin, Calif.

[73] Assignee: Durabag Co., Inc., Tustin, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/879,685

[22] Filed: Jun. 24, 1997

Related U.S. Application Data

[63] Continuation of application No. 08/582,102, Jan. 2, 1996, abandoned.

[51] Int. Cl.[6] ..... B65D 33/14; B65D 1/34

[52] U.S. Cl. ..... 206/554; 383/9; 248/100

[58] Field of Search ..... 206/554, 806, 206/494; 383/8, 9, 37; 248/95, 97, 100; 211/50

[56] References Cited

U.S. PATENT DOCUMENTS

| | | | |
|---|---|---|---|
| Re. 33,264 | 7/1990 | Baxley et al. | 206/554 |
| 3,646,723 | 3/1972 | Meroney | 248/100 |
| 5,100,000 | 3/1992 | Huseman | 206/554 |
| 5,207,328 | 5/1993 | Bose et al. | 206/554 |
| 5,213,145 | 5/1993 | Huang et al. | 206/554 |
| 5,323,909 | 6/1994 | Piraneo et al. | 206/554 |
| 5,333,730 | 8/1994 | Boyd | 206/554 |
| 5,346,310 | 9/1994 | Nguyen | 206/554 |
| 5,465,845 | 11/1995 | Norby et al. | 206/554 |
| 5,467,572 | 11/1995 | Wile et al. | 206/554 |
| 5,584,402 | 12/1996 | Johnson | 206/554 |

*Primary Examiner*—Paul T. Sewell
*Assistant Examiner*—Luan K. Bui
*Attorney, Agent, or Firm*—Wagner, Middlebrook & Kimbell, LLP

[57] ABSTRACT

A slidable bagging rack system. The rack has a slanted back portion which slants downwardly from an upper portion to a lower portion, and has a pair spaced apart support arms with risers which extend above the upper portion of the rack. Spaced midway between the support arms is a hook member. A pack of bags, such as T-shirt bags, is loaded on the rack by pushing the risers through apertures formed in the handles and by pushing the hook member through a mouth tab aperture formed in a mouth tab of the bags. Pulling a front wall of the bag tears the handles free of their handle aperture from the risers and tears the mouth tab of the front wall free, thereby readying the bag for loading with merchandise. The slanted back not only supports the bags, but effectively lowers the level of the open mouth of the bag.

15 Claims, 2 Drawing Sheets

FIG. 1
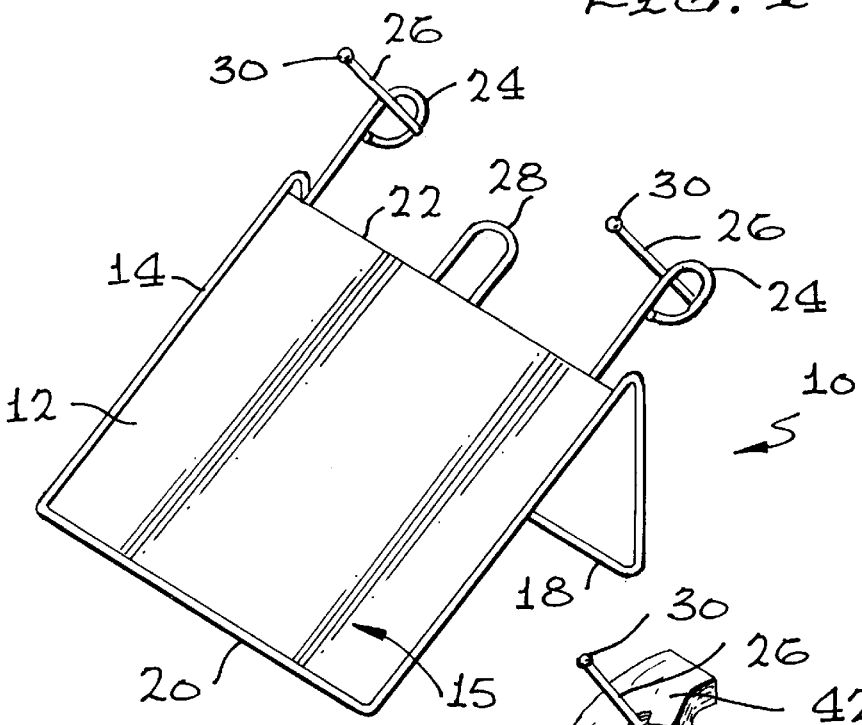
FIG. 2
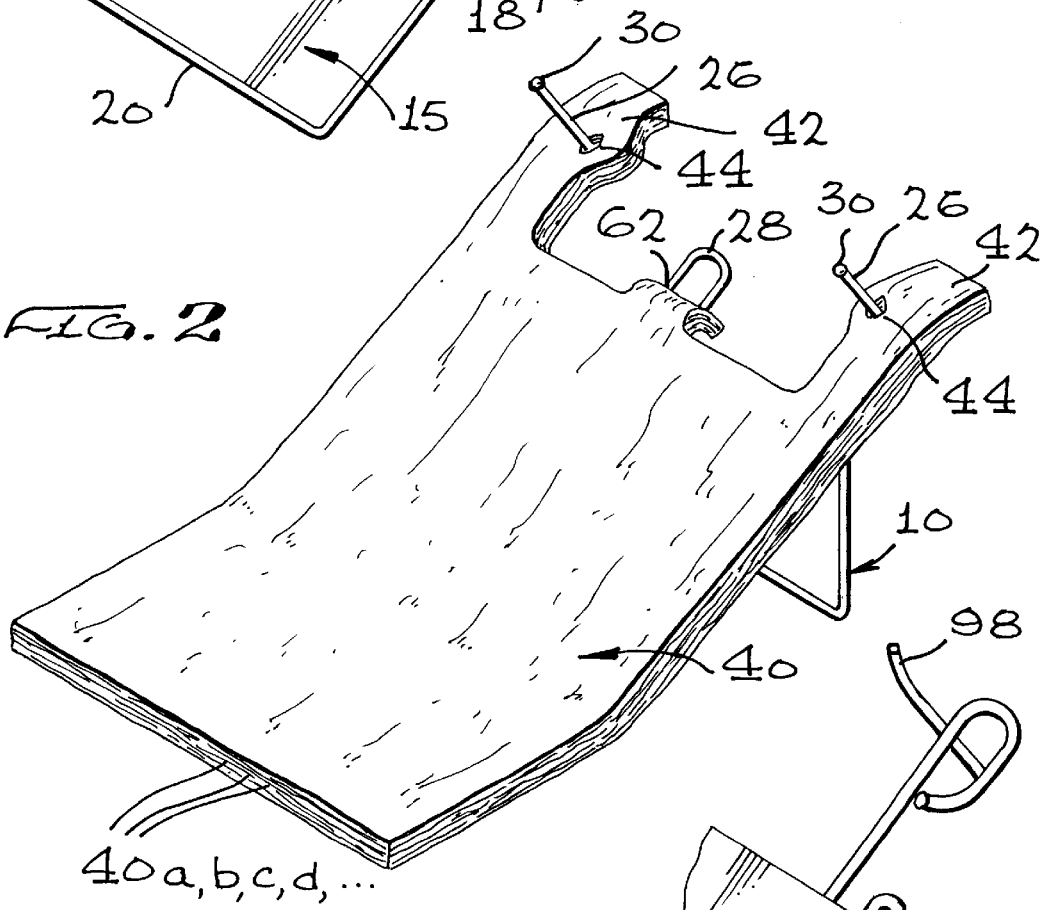
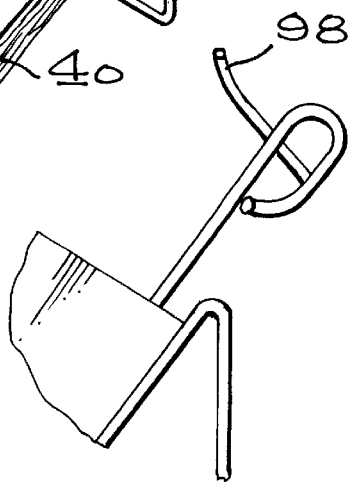
FIG. 8

FIG. 3
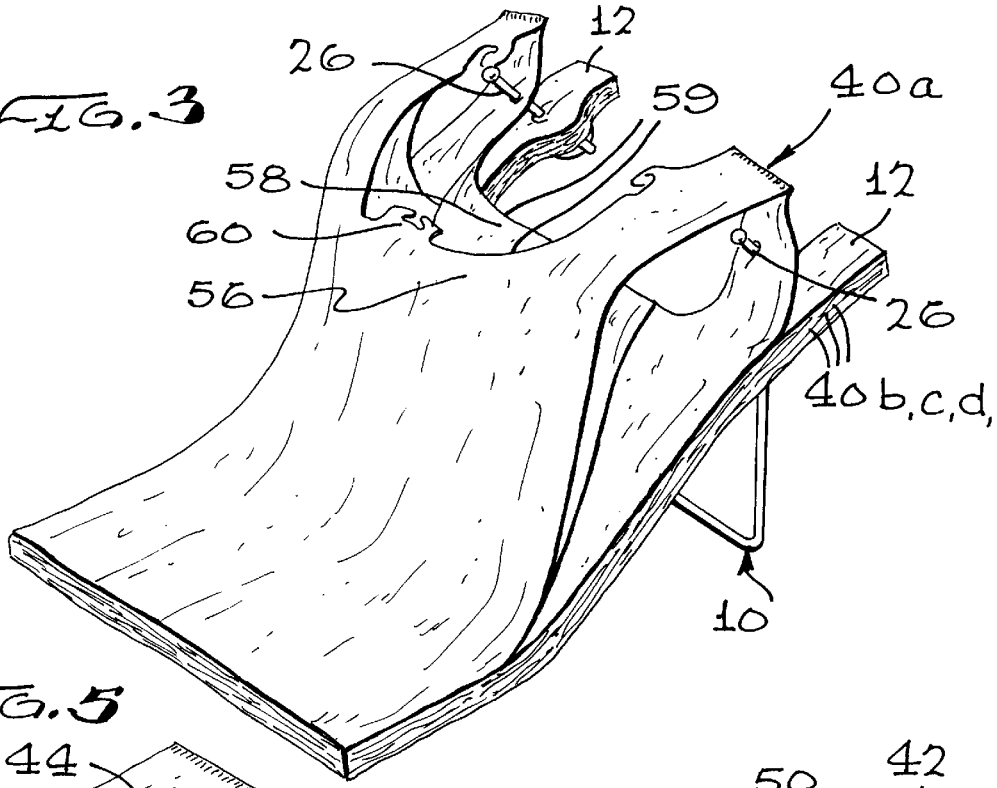
FIG. 5
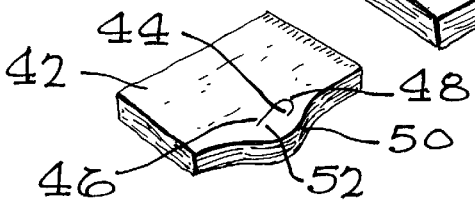
FIG. 7
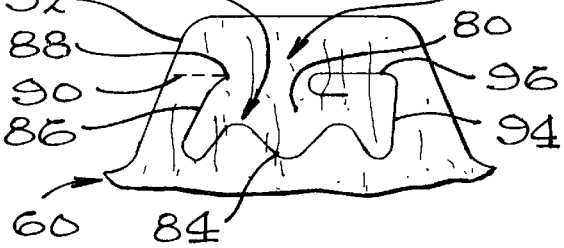
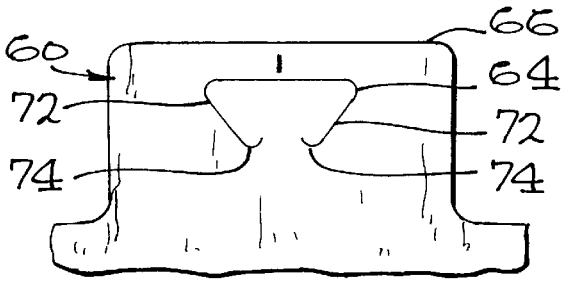
FIG. 6
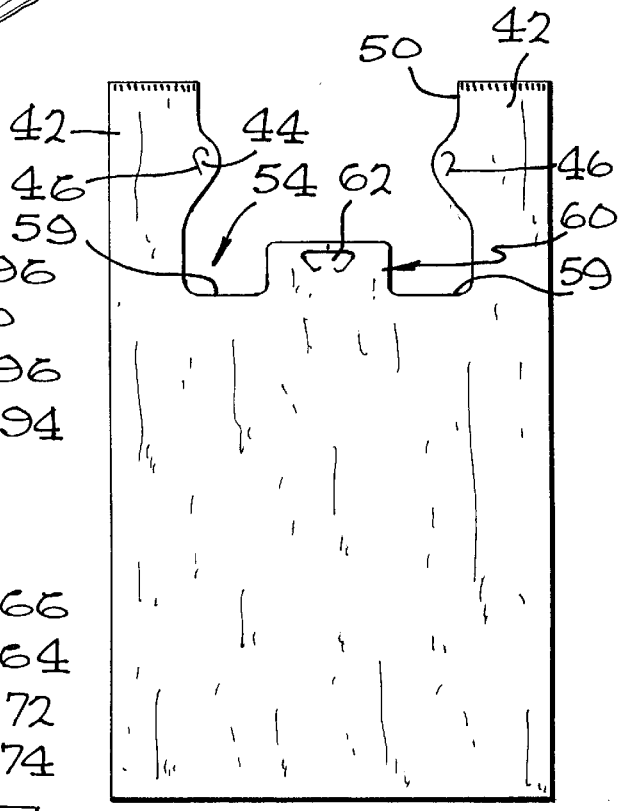
FIG. 4

READILY MOVABLE RECLINED BAG RACK AND BAGGING RACK SYSTEM THEREOF

This application is a continuation of application Ser. No. 08/582,102, filed on Jan. 2, 1996, now abandoned.

BACKGROUND OF THE INVENTION

1. Field of the Invention

This invention relates to racks for use in holding packs of plastic bags, and more particularly, to a easily movable slidable, slanted back rack for holding packs of bags, and particularly T-shirt bag packs, which rack and pack of bags can be easily moved around and located on a cashier's checkout counter and efficiently loaded with merchandise.

2. Description of the Prior Art

T-shirt bags are pleated bags which are closed at a bottom edge and have a pair of integral handles extending upwardly to define an open mouth of the bag therebetween. Plastic T-shirt shopping bags have many advantages over paper bags. Plastic T-shirt bags are typically made of low, linear-low, or high density polyethylene (LDPE, LLDPE, and HDPE, respectively), and are stronger, lighter, waterproof, easier to carry when loaded with merchandise, and take up less storage space than paper bags, saving valuable storage space at the merchants' checkout counters and storage areas. Plastic T-shirt bags can be manufactured and sold much less expensively than competing paper bags, making them the bags of choice for merchants.

The handles make the grocery loaded T-shirt bags easier to carry these paper bags. Because high density polyethylene (HDPE) has a greater resistance to stretching and deformation, plastic material containing at least some HDPE is generally used for making T-shirt bags, although LLDPE, LDPE, and other polyolefins can also be used. T-shirt bags are normally provided in packs of aligned bags.

Despite the many advantages T-shirt bags have over paper bags, unlike thicker and stiffer paper bags with a discreet flat bottom, they are not self-standing. In most retail grocery stores settings, where quick and easy loading of bags is desirable, T-shirt bags are provided in stacks or packs which are generally supported on a bagging rack to aid in loading the bag with merchandise. In the grocery store setting, a typical check-out counter set-up includes a counter surface where the merchandise is rung up, and a lower platform, upon which sits a T-shirt bagging rack, with the open mouth of the bag being at or below the counter surface level. These racks are purposely made to be somewhat heavy so that they are stable, and not easily knocked down.

There are several popular styles of T-shirt bags and bagging racks for use therewith, two main types of which will be discussed. In one type of T-shirt bag bagging rack, the bagging rack has a support base, a wire rear wall with a tab receiving hook, and two wire arms extending forwardly over the base. In the center top portion of the arms, the wire is formed so as to have a section which will spread and hold apart the handles of T-shirt bags engaged therewith to open up the mouth of the T-shirt bag. The pack of T-shirt bags used with these styles of bagging racks consists of a stack of overlapped and aligned bags which have a lower bag portion with two handles extending upwardly at both sides of the mouth of the bag. A central tab portion is provided on the mouth of the bags between the two handles, and the central tab portions of the pack of bags are held together. The central tabs thus form a book of central tabs and have a central tab slit formed therethrough. The central tab slit is engaged with the tab receiving hook on the rear wall of the bagging rack, and the book of central tabs will remain engaged therewith, even after individual bags are removed. Below the central tab slit a tearing slit is provided which transverses almost the entire distance of the central tabs except for a small distance at both sides of the central tab. The tearing slit allows the individual bags to be torn off the pack of bags as they are needed, and looped onto the bagging rack.

Alternately, the central tab portion can simply have a single central tab slit, which is also used to suspend the bag pack on a central tab receiving hook, which is torn through when a plastic bag is removed from the pack. This style of bag pack leaves no book of tabs on the bag rack's hook.

A second major type of pack of T-shirt bag, and bagging rack designed to be used therewith, are disclosed in U.S. Pat. No. Re. 33,264 to Baxley, et al. Another version of this style of bagging rack is disclosed in U.S. Pat. No. 4,840,336 to Stroh, et al. Both of these bagging racks have a bottom support base and a rear wire wall with a tab receiving hook located thereon. However, to open up each individual bag for loading, instead of looping the handles of the bags over the top of the support arm one at a time, as is done with the first type of pack of bags and rack, these racks have two handle support rods extending forwardly from the rear wire wall of the rack. The pack of T-shirt bags used with these styles of racks are similar to those used with the first type of rack, except that aligned apertures are formed on each handle of the pack of bags, through which pass the handle support rods of the bagging rack.

A third type of bagging rack, but not for use with T-shirt bags, is discussed in U.S. Pat. No. 5,100,000 to Huseman. The Huseman rack is for use with packs of recloseable flat zippered bags. It utilizes an A-frame structure, with suspension pegs to hold the pack of bags thereon. As each bag is torn free from the rack, a book of suspension pegs is left on the bagging rack. To remove a loaded bag, the bag must be torn free from the hook of bags and carefully detached from a third suspension peg without tearing the bag. While the Huseman system works for flat zippered bags, it would not be easily adaptable to T-shirt bags.

All of these prior art bagging racks suffer from drawbacks. In the case of the first two mentioned racks, they are relatively heavy and bulky, and not easy to move around on a clerks checkout counter. Also, since the open mouth of the bag on the bagging rack is raised relatively high, this style of bagging rack is typically placed on a shelf lowered relative to the level of the bagging counter. so that it's open mouth is generally at the level of the bagging counter. With regard to the third type of rack described above, it is not readily adapted for use with T-shirt bags.

There accordingly remains a need for a bag rack and bagging system which can be readily moved about on a cashier's checkout counter as needed and easily loaded with merchandise, and which is adapted to be used with a variety of not just T-shirt bag packs, but other bag pack as well.

SUMMARY OF THE INVENTION

The present invention overcomes the above noted deficiencies of the presently available T-shirt bags by providing a new type of bagging rack and bag rack system which is compact and lightweight, and can be readily moved around on the cashier's checkout counter, and which allows merchandise to be easily loaded into the bags by sliding it through the open mouth.

The present invention also provides a bagging rack which is also adapted to permit a variety of different bag pack styles to be used therewith.

These and other objects of the invention are promoted by providing a slidable bagging rack for use with packs of bags having a pair of spaced apart handles and a mouth tab, said bagging rack comprising:

a slanted back portion with a lower region and an upper region, said upper region being elevated relative to said lower region;

a pair of spaced apart risers which extend from said upper region, for use in retaining the handles of a bag pack on the bagging rack; and a hook member on said slanted pack portion for retaining a mouth tab of the bag pack on said slanted pack portion.

The invention further provides a slidable bagging rack system, comprising:

a slanted back bagging rack having a slanted back portion with a lower region and an upper region, said slanted back upper region being raised relative to said lower region, a pair of spaced apart risers and a hook member which extend from said upper region; and a pack of bags, comprising a stack of aligned bags, each bag having a pair of handles which extend upwardly, straddling a mouth region, and a central mouth tab which extends from front and rear walls of each bag above said mouth region, said handles and said mouth tab having apertures formed through for suspension of the bag pack on said risers and said hook member, respectively, of said bagging rack.

BRIEF DESCRIPTION OF THE DRAWINGS

FIG. 1 is a perspective view of the slidable bagging rack of the invention;

FIG. 2 is a perspective view of the bagging rack of FIG. 1 loaded with a pack of novel plastic T-shirt bags;

FIG. 3 is a perspective view of the bagging rack and T-shirt bags of FIG. 2, with the front most bag opened up for loading with merchandise;

FIG. 4 is a top plan view of a pack of T-shirt bags used with the invention, showing the tear-through mounting flap in the mouth tab, and the handle tear-through aperture;

FIG. 5 is a detail of the handle tear-through aperture;

FIG. 6 is a detail of the mounting flap in the mouth tab area of the bag of FIG. 3;

FIG. 7 is a detail of another style of mounting flap in the mouth tab area of the bag; and FIG. 8 is detail showing an alternate embodiment of the riser portion of the slidable bagging rack of the invention.

DESCRIPTION OF THE PREFERRED EMBODIMENT

Referring now to the drawings, there is illustrated in FIG. 1, a perspective view of a first embodiment the bagging rack 10 of the invention. The bagging rack 10 has a slanted back plate 12 which is carried by a frame member 14. At its upper region 15, the frame member 14 has supporting legs 16 joined at a bottom bar 18. The front edge 20 of the rack lies on the counter surface. The bagging rack's slanting back plate 12 and supporting legs 16 can alternately comprise a single piece of bent material (e.g. sheet metal or plastic), and the frame member 14 can thus be eliminated, if desired. The inventor has found that a slant of the back plate 12 of about 35 degrees off of the horizontal plane works well, although other degrees of slant also function. Extending further above the top edge 22 of the slanted back plate 12 are a pair of spaced apart support arms 24. These arms 24 can be generally parallel to the plane of the slant back 12.

The pair of spaced apart support arms 24 each have a riser portion 26 which extends outwardly from the support arms 24 and the slanted back support plate 12. A central tab hook 28 is positioned to extend above the top edge 22 of the slanted back plate 12 and lies midway between the two support arms 24. Depending on the type of bag pack the rack 10 will be used with, the outwardly extending riser portions 26 may have enlarged ends 30, such as provided by ball ends. If desired, if the slanted back plate 12 is long enough, separate support arms can be eliminated. These risers 26 are used to retain and support the handles of a bag pack, as will be described below.

Turning now to FIGS. 2 and 3, the slanted back bagging rack 10 of FIG. 1 is shown loaded with a pack of novel T-shirt bags 40. Referring to FIGS. 3–7 these packs of T-shirt bags consist of a stack of individual T-shirt bags 40*a, b, c, d,* etc., with upwardly extending handles 42. A handle mounting aperture 44 is formed by a cut line 46 through each handle 42. The top portion 48 of the handle mounting aperture's cut line 46 curves toward inner side edges 50 of the handles 42. The lower region 52 of the cut line 46 slants inwardly toward the inner side edge 50 of handles 42. The shape of the handle mounting aperture 44 is designed so that any tearing force acting on the cut line 46 will be directed inwardly toward the inner edge 50 of the handles 42, where it will not damage the structural integrity of the handles 42. The lower region 52 of the cut line 46 is designed so that the tearing force caused by removing a bag 40 from the pack of bags will propagate the cut line 46 past its lower region 46 and through to the inner edge 50 of the handles 42. Each of the bags 40 is closed at a bottom edge 53 thereof.

Located between the two bag handles 42 is the mouth region 54. Extending upwardly from the upper edges 59 of the front and rear walls 56 and 58, respectively, are the bag mouth tabs 60. As best shown in FIGS. 4 and 6, a mouth tab flap 62 is formed by a cut line 64 through the mouth tabs 60. Spaced above the uppermost portion of the cut line 64 and below the topmost edge 66 of the tab, a generally vertical weakening cut 68 is formed. The cut line 64 has a generally horizontal top region 70 and two sides 66 which slant toward each other and whose ends terminate as inwardly and upwardly directed curved ends 74.

Referring to FIG. 7, an alternate style of mouth flap 80 is shown formed in the mouth tab 60. In this embodiment, the cut line 82 follows a more circuitous route and has a generally sinusoidally shaped lower region 84, connected at a first side with an upwardly directed cut line 86. The terminating upper end 88 of the cut 86 line intersects a generally horizontally formed weakened area 90. The weakened area 90 can be made by perforating slits or holes, and it intersects the adjacent side edge 92 of the mouth tab 80. The other side of the generally sinusoidally shaped lower region 84 connects to a cut line portion 94 which extends upwardly, then toward the center 96 of the mouth tab, then curve down, and back toward the cut line portion 94.

Turning again to FIGS. 2 and 3, a pack of bags 40*a, b, c, d,* etc. of the embodiment of FIG. 4 is shown loaded on the bagging rack 10. The handle 42 of the bag pack 40*a, b, c, d,* etc. are supported on the rack 10 by threading the handle mounting apertures 44 onto the riser portions 26 of the rack 10. This is done for both handles 42. The mouth tap aperture 62 is slipped over the central tap mounting hook 28, thereby retaining the pack of bags 40*a, b, c, d,* etc. in a generally slanted back orientation with the bags 10*a* rear wall 58 supported by the slanted back plate 12.

The operation of the bagging rack 10 and pack of bags 40*a, b, c, d,* etc. is now described with reference to FIGS. 2 and 3, utilizing a bag pack 40*a, b, c, d,* etc. of the type illustrated in FIG. 6. A checkout clerk desiring to use the rack bag pack system will first move the rack 10 and its loaded pack of bags 40*a, b, c, d,* etc. to a desired position on the checkout counter. The front wall 56 of the topmost bag 40*a* will be pulled forward, while the rear wall 58 will continue to be supported on the bagging rack 10. This causes the front wall of the mouth tab flap 62 to tear free at the weakened position 68. By continuing to pull, the handles 42 will also tear free from their mounting flap 44, thusly opening the topmost bag 40*a* for loading with groceries. The slant back design of the rack 10 positions the open mouth 84 of the bag conveniently not too far off the counter, which allows the checkout clerk to conveniently place merchandise in the bag. The slanted back plate 12 will support the bag 10*a* as merchandise is being loaded therein by sliding through the open mouth 84. After the bag 10*a* is fully loaded, the clerk will simply grasp the two handles, and pull, thereby freeing the merchandise loaded bag. The cycle can then be repeated.

The spacing apart of the two risen portion 26 is preferably approximately the same as the spacing apart of the handle flaps 44. If the rack 10 will be used exclusively or predominately for novel bag packs of FIGS. 4–7, then the outwardly extending riser portions 26 may have enlarged ends 30, such as provided by enlarged spheres (e.g. ball bearings) affixed to the ends. These enlarged ends 30 prevent bag handles of any bag other than the topmost bag from slipping off the extensions 24. However, enlarged ends 30 are not required, particularly, if the bag rack 10 of the invention is to be used with other designs of bag packs, such as bag packs whose handle and/or mouth tab apertures are not designed to be torn through as each individual bag is removed from the rack (not shown). Lastly, referring to FIG. 8, the risers portion 98 can be curved in lieu of having enlarged ends to help better retain bag packs.

While the bagging rack 10 of the invention is ideally suited for use with the two styles of T-shirt bag pack 12 shown in the drawing, it will also function well for use with other styles of T-shirt bag packs, without tear through handle apertures and/or mouth tab apertures, and will also function well for non-T-shirt style bag packs.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purposes of limitation, the scope of the invention being delineated in the following claims.

We claim:

1. A slideable bagging rack system adapted to be used with packs of T-shirt bags, the packs of T-shirt bags having a plurality of bags stacked in alignment, each bag in the pack of T-shirt bag having a pair of spaced apart handles straddling a mouth region of the T-shirt bag with a mouth tab thereabove, apertures formed in the handles of the T-shirt bags and in the mouth tab, said bagging rack system comprising:

a slanted back plate portion with a lower region and an upper edge, said upper edge being elevated relative to said lower region;

a pair of spaced apart support arms which project upwardly and extend above said upper edge and which are on a plane generally parallel to the back plate portion, the support arms having riser portions which extend outwardly from the support arms for use in retaining handles of a pack of T-shirt bags on the bagging rack at a position raised above the upper edge of the slanted back plate portion; and a hook member on said slanted back portion for retaining a mouth tab of a pack of T-shirt bags on said slanted back portion.

2. The slideable bagging rack of claim 1, further comprising leg members which are adapted to elevate said upper region of said slanted back portion.

3. The slideable bagging rack of claim 1, wherein said hook member extends from the upper edge of said slanted back plate portion.

4. The slideable bagging rack of claim 1, wherein said riser portions have enlarged ends.

5. The slideable bagging rack of claim 1, wherein said riser portions are upwardly curved.

6. The slideable bagging rack of claim 1, wherein the slanted back portion is slanted about 35 degrees off of the horizontal plane.

7. A slideable bagging rack system adapted to be used with packs of T-shirt bags, comprising:

a slanted back bag bagging rack having a slanted back plate portion with a lower region and an upper edge, said upper edge being raised relative to said lower region, a pair of spaced apart support arms which project upwardly and extend above said upper edge and which are on a plane generally parallel to the back plate portion, the support arms having riser portions which extend outwardly from the support arms, and a hook member between the spaced apart risers, and wherein the upper region of the slanted back portion is relatively close to counter surface, so that a mouth region of a bag pack mounted thereon is relatively close to the counter surface for easy loading of merchandise; and a pack of bags, comprising a stack of aligned bags, each bag having a pair of handles which extend upwardly, straddling a mouth region, and a central mouth tab which extends from front and rear walls of each bag above said mouth region, said handles and said mouth tab having apertures formed through for suspension of the bag pack on said risers and said hook member, respectively, of said bagging rack, the apertures in handles being spaced apart a certain distance, the bags having a length between the handle apertures and a bottom edge of the bags, and wherein the distance between the pair of spaced apart risers and the lower region of the slanted back portion is less than the length of the bags between their handle apertures and their bottom edges, so that at least a portion of the bag packs will rest on the counter surface and so that the mouth region of the bag packs will remain near the upper edge of the slanted back plate portion for convenient loading.

8. The slideable bagging rack system of claim 7, wherein said slanted back portion is elevated at said upper region by leg members and which rests on the counter surface on said lower region.

9. The slideable bagging rack of claim 7, wherein said risers are on a plane generally perpendicular to the plane of the slanted back portion.

10. The slideable bagging rack system of claim 9, wherein said spaced apart risers have enlarged heads at terminal ends, and said risers are spaced apart by approximately the same distance as the apertures in the handles of the pack of bags, and said wherein risers are located at positions above said upper region of the slanted back portion such that when a pack of bags is loaded on the rack, the pack of bags will lay relatively flat thereon.

11. The slideable bagging rack of claim 7, wherein said handle aperture comprises a cut line which has an upper curved portion, which is directed toward an inner side edge of the handles, and a lower portion which slants inwardly toward the inner side edge of the handles.

12. The slideable bagging rack system of claim 7, wherein the mouth tab aperture in said central mouth tab comprises a cut line which has a generally horizontal upper component, connected to two side components which turn downwardly and toward the center of the mouth tab with upturned ends said end regions preventing the cut line from propagating downwardly and weakening the bag, and further comprises a weakened area comprising a vertical cut line formed between the generally horizontal upper component of the cut line forming the mouth tab aperture, and a top edge of the mouth tab.

13. The slideable bagging rack of claim 7, wherein said risers have enlarged ends.

14. The slideable bagging rack of claim 7, wherein said risers are upwardly curved.

15. The slideable bagging rack system of claim 7, wherein the slanted back portion is slanted about 35 degrees off of the horizontal plane.

* * * * *

UNITED STATES PATENT AND TRADEMARK OFFICE

CERTIFICATE OF CORRECTION

PATENT NO. : 5,941,392
DATED : August 24, 1999
INVENTOR(S) : Frank Feng Jung Huang; Daniel Huang It is certified that error appears in the above-identified patent and that said Letters Patent is hereby corrected as shown below:

Column 8,
Line 11, after "rack" delete "system".

Signed and Sealed this

Twentieth Day of November, 2001

*Attest:*

Nicholas P. Godici

*Attesting Officer*

NICHOLAS P. GODICI
*Acting Director of the United States Patent and Trademark Office*